US005537852A

United States Patent [19]

Del Fabro et al.

[11] Patent Number: 5,537,852

[45] Date of Patent: Jul. 23, 1996

[54] BENDING ASSEMBLY OF A BENDING MACHINE

[75] Inventors: Marcello Del Fabro, Udine; Giorgio Del Fabro, Cassacco-Fraz.Montegnacco, both of Italy

[73] Assignee: M.E.P. Macchine Elettroniche Piegatrici SpA, Reana del Rojale, Italy

[21] Appl. No.: 359,606

[22] Filed: Dec. 20, 1994

[30] Foreign Application Priority Data

Dec. 22, 1993 [IT] Italy ..... UD93A0255

[51] Int. Cl.[6] ..... B21D 7/02

[52] U.S. Cl. ..... 72/387; 72/217; 72/218

[58] Field of Search ..... 72/217, 218, 219, 72/304, 387

[56] References Cited

U.S. PATENT DOCUMENTS

| | | | |
|---|---|---|---|
| 3,894,422 | 7/1975 | Peddinghaus | 72/217 |
| 3,991,600 | 11/1976 | Del Fabro | 72/217 |
| 5,203,195 | 4/1993 | Ritter et al. | 72/218 |

FOREIGN PATENT DOCUMENTS

| | | | |
|---|---|---|---|
| 123231 | 10/1984 | European Pat. Off. | B21D 11/12 |
| 379043 | 7/1990 | European Pat. Off. | B21D 11/12 |
| 502341 | 9/1992 | European Pat. Off. | B21D 11/12 |
| 1284936 | 3/1961 | France | B21D 11/12 |
| 2177934 | 3/1973 | France | B21D 11/12 |
| 803970 | 4/1951 | Germany | 72/217 |
| 317206 | 12/1956 | Switzerland | 72/217 |

*Primary Examiner*—David Jones
*Attorney, Agent, or Firm*—Antonelli, Terry, Stout & Kraus

[57] ABSTRACT

Bending assembly of a bending machine (13), which can be employed to make upstream or downstream, clockwise or anticlockwise, bends of up to 180° and more, on a bundle of bars (14) stacked on each other and lying on a plane substantially perpendicular to a working surface (15), the bending assembly (10) comprising an abutment plate (16) with two opposed abutment pins (17) and a rotary bending plate (11) coaxial with, and external to, the abutment plate (16) and including a bending pin (12), the abutment pins (17) and bending pin (12) having their axes substantially at a right angle to the working surface (15), the abutment plate (16) being able to rotate on its own perpendicular axis and including the two diametrically opposed abutment pins (17) with a space between those two abutment pins (17) at least equal to the diameter of the bars forming the bundle (14) of bars.

7 Claims, 2 Drawing Sheets

BENDING ASSEMBLY OF A BENDING MACHINE

BACKGROUND OF THE INVENTION

This invention concerns a bending assembly of a bending machine.

The bending assembly is applied to machines which bend iron products for building work, whether those products are made from bars or rolls, but which advantageously process round, ribbed or shaped bars.

The bending assembly according to the invention is fitted advantageously, but not only, to bending machines of the type disclosed in EP-A-0.501.212.

The bending machines to which this invention is applied are normally used to bend in four directions bundles of bars in which the bars are stacked on each other vertically so as to produce the same geometric configuration from each bar of the bundle, these geometric configurations being used in building work as stirrups for the reinforcement of reinforced concrete.

The bundle of bars is fed in these bending machines until it cooperates with a bending assembly, which is suitably actuated to make the desired bend.

In the following text the word "upstream" means the position upstream of the bending assembly, whereas the word "downstream" means the position downstream of the bending assembly.

In the state of the art the bending assemblies consist of a stationary abutment pin and of a bending pin which rotates about the abutment pin to bend the bundle of bars.

The bending assembly consists of a rotary bending plate on which is located a bending pin substantially perpendicular to the rotary bending plate, the pin being offset from the central axis of rotation of the rotary bending plate.

U.S. Pat. No. 4,049,026 discloses a bending assembly consisting of two stationary abutment elements coupled to define a feed channel along which the bundle of bars to be bent is fed. These abutment elements have their righthand end suitably shaped as a semi-circle, against which the bundle of bars is rested when being bent by a bending pin positioned downstream of the abutment elements and moved by the rotation of the rotary bending plate.

This first form of embodiment enables downstream bends, whether clockwise or anticlockwise, to be made and in particular makes also possible the formation of downstream bends of 180° in most cases.

In some cases, where the bars consist of certain materials, it is impossible to make 180° bends with such types of abutment elements. This embodiment also does not enable any upstream bend to be made.

The above patent discloses another bending machine able to make downstream and upstream bends; in this machine the abutment assembly with which the bar cooperates during the bending step consists of two elements extending lengthwise and facing each other so as to define a stationary feed channel.

But this embodiment does not enable 180° bends to be made inasmuch as it is known that, owing to the resilience of the bars, the bars, if a bend of a given angle has to be made, have to be bent by a greater angle because the bars spring back resiliently after the bending pin has been removed from them.

In this second form of embodiment at least the segment of the bar in contact with the lengthwise surface of the abutment elements is bent by 180° during the bending step but then springs back to define an angle less than 180° when the bending pin is removed.

FR-A-2.177.934 discloses a bending assembly cooperating with stationary abutment means positioned upstream and external to the bending assembly of a rotary type; this bending assembly makes possible only the production of downstream bends, whether clockwise or anticlockwise, but does not make possible the production of upstream bends.

FR-A-1.284.936 discloses a bending assembly in which the working surface includes both upstream and downstream of the bending assembly a plurality of aligned holes with which there cooperate retaining and clamping means that have to be positioned by hand on each occasion according to the diameter of the bars forming the bundle and according to the diameter of the abutment pin.

These operations of positioning by hand the retaining and clamping means make the bending operations long and complicated and thereby reduce considerably the output of the bending machine.

So as to overcome these shortcomings, EP-A-0.501.212 and EP-A-0.502,341 disclose bending machines in which the abutment element consists of a central stationary abutment pin.

To ensure that the part of the bar not bent by the bending pin does not deform but remains straight, this bending machine includes four retaining and clamping means, which can be actuated momentarily and be retracted momentarily. These four retaining and clamping means are arranged in pairs upstream and downstream respectively of the bending assembly; each pair consists of two retaining and clamping means positioned on the opposite sides of the bundle of bars being fed.

To be more exact, these retaining and clamping means have a first working position, in which they protrude from the working surface feeding the bundle of bars and cooperate with that bundle of bars to be bent, and a second retracted inactive position, in which they lie below the working surface.

When a given bend has to be made, the retaining and clamping means cooperating with the end of the bundle of bars opposite to the end to be bent are brought to their working position, whereas the other retaining and clamping means stay in their inactive position.

The inclusion of these retaining and clamping means capable of a movement perpendicular to the surface on which the bundle of bars slides makes the bending machine more complicated and therefore more costly.

Moreover, these movable retaining and clamping means require drive means, such as jacks for instance, which have to be operated automatically according to the bend to be made.

These retaining and clamping means, therefore, entail a plurality of additional elements on the bending machine and have to be operated by the control and governing unit of the bending machine.

Such retaining and clamping means involve higher costs of construction and of management and maintenance of the bending machine.

Furthermore, these retaining and clamping means also require a plurality of specific spare parts, which lead also to greater investments in storage for spares.

EP-A-0.123.231 discloses a bending machine in which the bending assembly comprises an abutment plate which cannot be rotated and a rotary bending plate coaxial with, and external to, the non-rotatable abutment plate.

The abutment plate bears two opposed abutment pins arranged in a plane perpendicular to the plane of feed of the bundle of bars; these two abutment pins define a stationary feed corridor having a constant width defined by the diameter of the abutment pins and by the distance between their centres; in this corridor there passes the bundle of bars to be bent.

During the bending step the bundle of bars is caused to cooperate with one or the other of the abutment pins, depending on whether a clockwise bend or an anticlockwise bend is required.

The bending plate too bears two bending pins arranged along a circumference and positioned at radial positions at a distance apart subtending an angle of about 45° at the centre of the abutment plate.

During the working step the two bending pins too are positioned on opposite sides of the bundle of bars.

Depending on the type of bend, whether clockwise or anticlockwise, to be produced, one or the other of the two bending pins cooperates with the bundle of bars, which rests only against the opposed abutment pin.

In this type of machine at least one of the rolls of the pair of feed rolls, which is positioned immediately upstream of the bending assembly, acts as a second abutment element for the bundle of bars during the bending step.

The abutment pins are positioned opposite and close to each other with a small play additional to the thickness of the bars.

The bending assembly of this type makes possible the production only of downstream bends, that is to say, bends external to the assembly of feed rolls/bending assembly, but does not make possible the production of upstream bends, that is to say, bends at a position between the feed rolls and bending assembly.

Next, it should be borne in mind that during the bending step the feed rolls, which are fitted as cantilevers and act as a second abutment element, undergo heavy stresses which could damage their supporting shafts with resulting problems linked to their operation.

SUMMARY OF THE INVENTION

The present applicants have designed, tested and embodied this invention to overcome the shortcomings of the state of the art and to achieve further advantages.

The purpose of this invention is to provide a bending assembly which enables any type of bends, even greater than 180°, to be made in a bundle of bars fed to a bending machine.

The bending assembly according to the invention is strong and practical and simple to make and operate, and consists of a limited number of parts.

The bending assembly according to the invention makes possible the elimination of the means that retain and clamp the bundle of bars both upstream and downstream of the bending assembly in the bending machines of the state of the art.

The bending assembly according to the invention acts at the same time as retaining and clamping means and as an abutment means for the bundle of bars during the bending step.

The bending assembly according to the invention comprises an abutment plate able to rotate about its own axis and also a rotary bending plate coaxial with, and external to, the abutment plate.

The rotary abutment plate includes two abutment pins positioned diametrically opposite to each other in relation to the axis of rotation of the abutment plate.

The rotary bending plate includes one single bending pin which, depending on the type of bend, is positioned on the right or left of the bundle of bars and on the opposite side of the relative abutment pin with which it is to cooperate.

The clamping of the bundle of bars takes place by rotating the rotary abutment plate until both the abutment pins are rested against the bundle of bars; these abutment pins are positioned in such a way as to obtain between them a space at least equal to the diameter of the bars.

In this position the abutment pin close to the bending pin and positioned on the opposite side of the bundle to the bending pin acts as the abutment pin for making the bend, whereas the abutment pin far from the bending pin and positioned on the same side of the bundle as the bending pin acts as a clamping and opposing pin that keeps the bundle of bars in position during the bending.

The two abutment pins associated with the abutment plate are advantageously of a replaceable type.

The rotary abutment plate has a first position for the introduction of the bundle of bars with the abutment pins positioned at the sides of the lengthwise axis of the bars and two working positions, which are respectively a second working position and a third working position with the abutment pins rested against the bundle of bars on the opposite surfaces of the bundle.

In the second working position the abutment pin nearer to the feeding assembly cooperates with the lefthand face of the bundle of bars, whereas in the third working position the abutment pin nearer to the feeding assembly cooperates with the righthand face of the bundle of bars.

The rotary bending plate has a first upstream bending position, in which the bending pin cooperates with the abutment pin farther from the feeding assembly, and a second downstream bending position, in which the bending pin cooperates with the abutment pin nearer to the feeding assembly.

In this way by means of the bending assembly according to the invention, by positioning in a desired coordinated manner the respective bending and abutment pins it is possible to produce upstream and downstream, clockwise or anticlockwise, bends.

According to a variant the abutment plate can advantageously be moved vertically and can therefore take up not only a first position, in which the rotary abutment plate lies on the same plane as the working surface, but also a second low position, in which the rotary abutment plate is positioned below the working surface, and/or a third high position, in which the rotary abutment plate is located above the working surface.

The bending plate too can advantageously be moved vertically and can take up a first position, in which the rotary bending plate lies on the same plane as the working surface, a second low position, in which the rotary bending plate is positioned lower than the working surface, and/or a third high position, in which the rotary bending plate is positioned higher than the working surface.

The second low position and third high position form variants.

During the bending step the abutment plate and the bending plate lie on the same plane as each other and both of them lie on the working plane of the bending machine with which they are associated.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 3A:
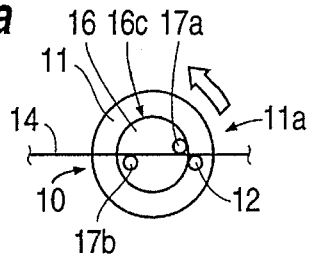
FIGS. 3*a* to 3*h* show diagrammatic plan views of the positions of the bending pin and of the abutment pins according to the invention in making various bends before and after the making of the bends respectively.

The reference number 10 in the attached figures denotes generally a bending assembly according to the invention.

The bending assembly 10 is associated with a machine 13 employed to bend a bundle of bars 14.

In this case a bending machine 13 of a horizontal type is shown which comprises a horizontal working surface 15.

In this case a bundle: of bars 14 consisting of a plurality of bars stacked vertically one on another is fed from the left towards the right on the working surface 15 by suitable feeder means, which are not shown here.

The feeder means may be of a pincers type or of a type with rolls installed upstream or upstream and downstream of the bending assembly 10.

The bending assembly 10 according to the invention includes a rotary abutment plate 16 and a rotary bending plate 11, which is coaxial with, and external to, the rotary abutment plate 16; the respective abutment plate 16 and rotary bending plate 11 can rotate about the same axis of rotation perpendicular to the working surface 15.

The rotary abutment plate 16 includes two abutment pins 17 positioned diametrically opposite to each other in relation to the axis of rotation.

The space between these two abutment pins 17 is at least equal to the diameter of the bars forming the bundle of bars 14.

The rotary bending plate 11 includes one single bending pin 12 positioned substantially at a right angle to the rotary bending plate 11.

The rotary bending plate 11 is shaped substantially as a ring including a central internal hole 23 with which the rotary abutment plate 16 cooperates.

In this case the abutment plate 16 has a first working position 116*a*, in which it lies on the same plane as the working surface 15.

The bending pin 12 and the abutment pins 17 are advantageously of a replaceable type and may vary according to the nominal diameter of the bars 14 to be bent.

In this case the rotary abutment plate 16 is driven in rotation by a first motor 18 positioned therebelow, whereas the rotary bending plate 11 is driven in rotation by a second motor 20.

The abutment pins 17 define a feeding channel 21 along which the bundle of bars 14 to be bent is fed.

The rotary abutment plate 16 has a first position 16*a* for introduction of the bundle of bars 14 with the abutment pins 17 arranged on opposite sides of the bundle of bars 14 and on a diameter substantially at a right angle to the direction of feed of the bundle of bars 14.

Figure 1:
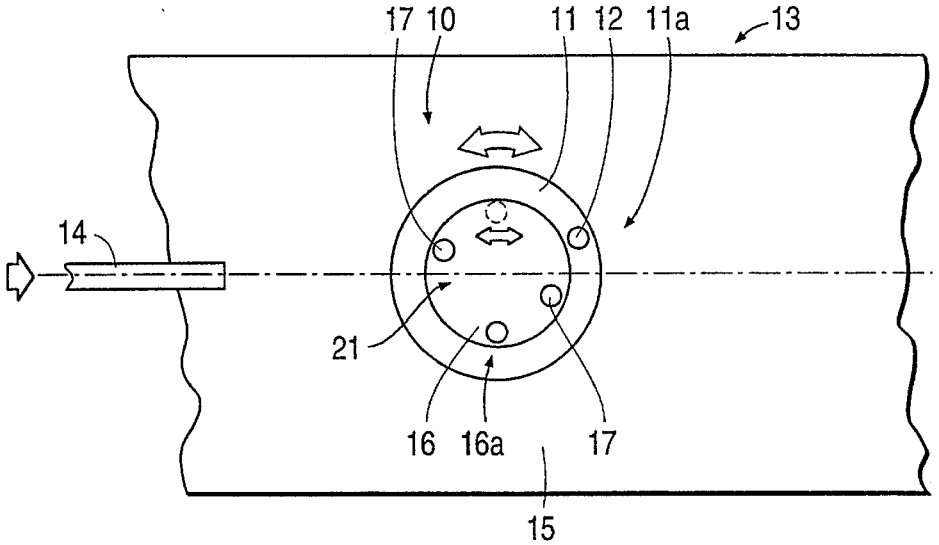
FIG. 1 is a diagrammatic plan view of a bending machine comprising the bending assembly according to the invention.

In FIG. 1 the position 16a of introduction of the bundle of bars 14 is shown with lines of dashes.

When the bundle of bars 14 has halted in the correct position, the rotary abutment plate 16 is rotated clockwise or anticlockwise, depending on the bend to be made, so as to be brought to the second 16*b* or third 16*c* working position, in which the two abutment pins 17 are rested against the opposite lateral faces of the bundle of bars 14.

The rotary bending plate 11 is now rotated clockwise or anticlockwise by a desired angle so as to be brought to the upstream bending position 11*a*, in which it cooperates with the abutment pin 17 farther from the feeding assembly, or to the downstream bending position 11*b*, in which it cooperates with the abutment pin 17 nearer to the feeding assembly.

During the bending step the abutment pin 17*a* located nearer to the bending pin 12 acts as an abutment element, whereas the abutment pin 17*b* located farther from the bending pin 12 acts as an element to retain and clamp the segment remaining straight of the bundle of bars 14.

Figure 3B:
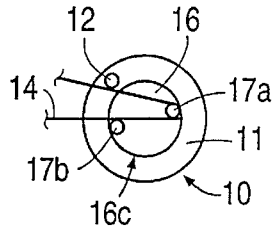
Figure 3C:
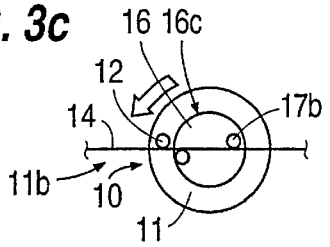
Figure 3D:
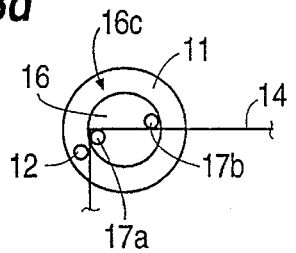
Figure 3E:
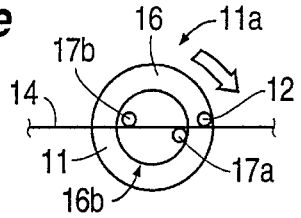
Figure 3F:
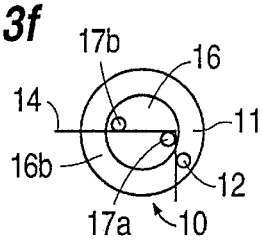
Figure 3G:
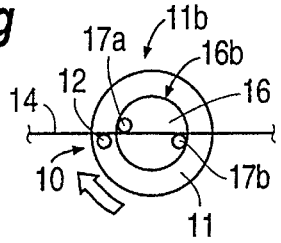
Figure 3H:
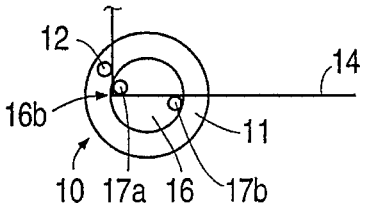

Depending on the type of bend to be made, the bending pin 12 and the respective abutment pins 17*a*–17*b* take up different positions, as shown in FIGS. 3. In particular:

- FIGS. 3*a* and 3*b* show the bending assembly 10 with the rotary abutment plate 16 in the third working position 16*c* and the rotary bending plate 11 in the upstream bending position 11*a* before (FIG. 3*a*) and after (FIG. 3*b*) respectively having made an anticlockwise upstream bend;
- FIGS. 3*c* and 3*d* show the bending assembly 10 with the rotary abutment plate 16 in the third working position 16*c* and the rotary bending plate 11 in the downstream bending position 11*b* before (FIG. 3*c*) and after (FIG. 3*d*) respectively having made an anticlockwise downstream bend;
- FIGS. 3*e* and 3*f* show the bending assembly 10 with the rotary abutment plate 16 in the second working position 16*b* and with the rotary bending plate 11 in the upstream bending position 11*a* before (FIG. 3*e*) and after (FIG. 3*f*) respectively having made a clockwise upstream bend;
- FIGS. 3*g* and 3*h* show the bending assembly 10 with the rotary abutment plate 16 in the second working position 16*b* and with the rotary bending plate 11 in the downstream bending position 11*b* before (FIG. 3*g*) and after (FIG. 3*h*) respectively having made a downstream clockwise bend.

Figure 2A:
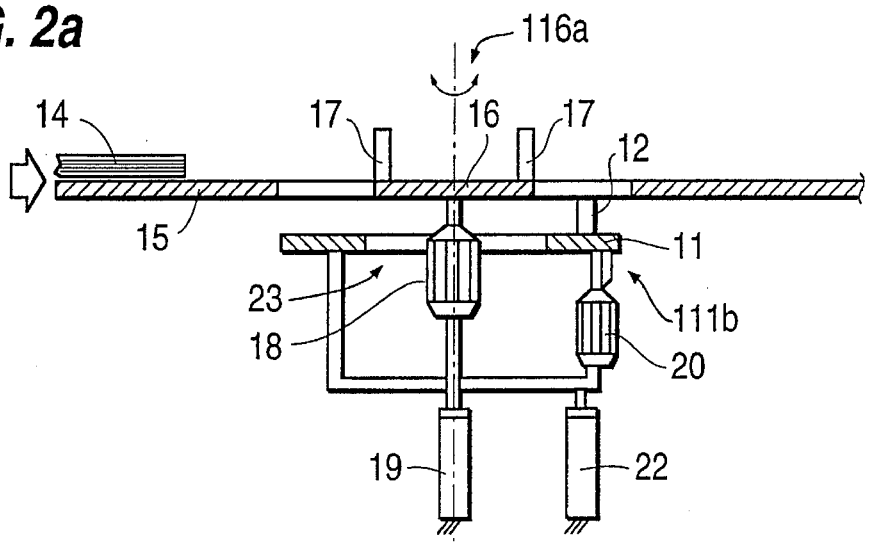
FIG. 2*a* shows a cross-section of the machine of FIG. 1 with the abutment plate in the working position and the bending plate in the low position.
Figure 2B:
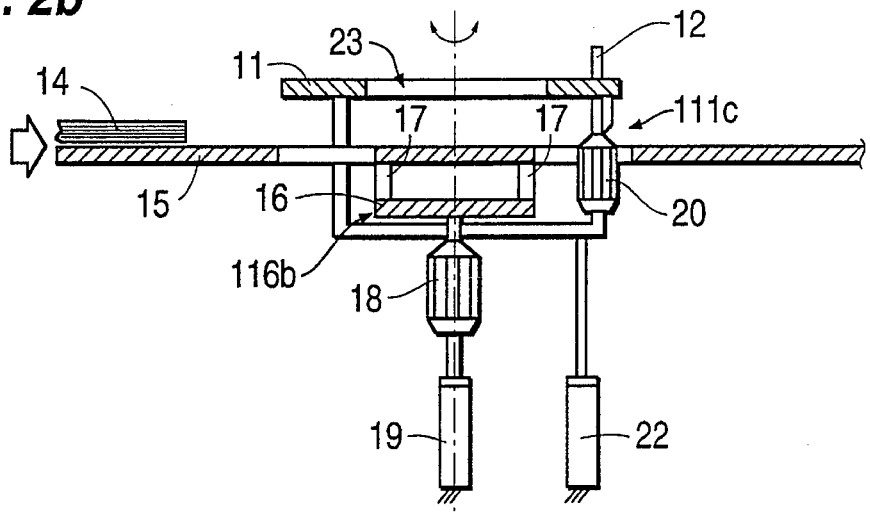
FIG. 2*b* shows a cross-section of the machine of FIG. 1 with the abutment plate in the low position and the bending plate in the high position.

According to a first variant the rotary abutment plate 16 can also be moved at a right angle to the working surface 15 and has a first coplanar position 116*a* (FIG. 2*a*), in which the rotary abutment plate 16 is coplanar with the working surface 15, and also a second low position 116*b*, in which the rotary abutment plate 16 is located lower than the working surface 15 (FIG. 2*b*).

The abutment plate 16 is brought to this second low position 116*b* to let the pincers-type feeder means pass and to prevent the feeder means coming into contact with the abutment pins 17.

Figure 2C:
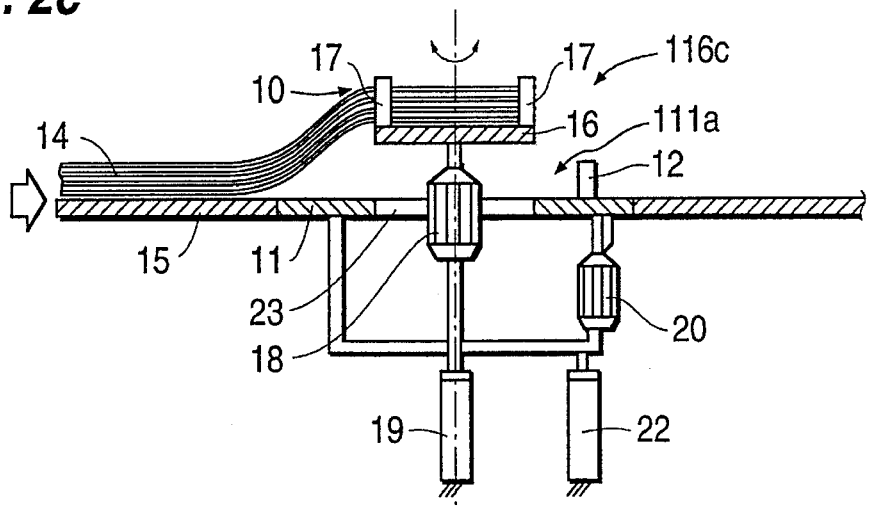
FIG. 2*c* shows a cross-section of the machine of FIG. 1 with the abutment plate in the high position and the bending plate in the working position.

According to another variant (FIG. 2*c*) the abutment plate 16 has a third high position 116*c*, in which the rotary abutment plate 16 is raised from the working surface 15; the abutment plate 16 is positioned in that third high position 116*c* to enable the rotary bending plate 11 to rotate so as to move the bending pin 12 from one side to the other side of the bundle of bars 14 if the rotary bending plate 11 cannot move vertically and does not have a low retracted position.

In this case the rotary abutment plate 16 is associated with first actuator means 19 so as to be brought to the first coplanar position 116*a*, to the second low position 116*b* or to the third high position 116*c* according to the various steps of the bending cycle.

In this case the rotary bending plate 11 too is advantageously of a vertically movable type and is suitable to take up a first coplanar position 111*a*, in which it is coplanar with the working surface 15 (FIG. 2*c*), a second low position 111*b*, in which it is located lower than the working surface 15 (FIG. 2*a*) and/or a third high position 111*c*, in which it is located higher than the working surface 15 (FIG. 2*b*).

In this case the rotary bending plate 11 can be moved vertically and is associated with second actuator means 22, which are actuated to bring the rotary bending plate 11 to the positions 111*a*, 111*b* and 111*c*.

We claim:

1. Bending assembly of a bending machine having a working surface, which can be employed to make upstream or downstream, clockwise or anticlockwise, bends of up to 180° and more, on a bundle of bars stacked on each other and lying on a plane substantially perpendicular to the working surface, the bending assembly comprising an abutment plate rotatable about an axis of rotation perpendicular to the working surface and having two abutment pins positioned offset from and diametrically opposite one another in relation to the axis of rotation of the abutment plate and each having a longitudinal axis substantially perpendicular to the working surface, whereby rotation of the abutment plate about the axis of rotation causes the two abutment pins to rest against opposite sides of the bundle of bars, and a rotary bending plate coaxial with, and external to, the abutment plate and including a bending pin having an axis substantially perpendicular to the working surface, wherein a space between the two abutment pins is at least equal to a diameter of the bars forming the bundle of bars and wherein rotation of the rotary bending plate causes the bending pin to bend the bundle of bars using one of the two abutment pins on an opposite side of the bundle as an abutment around which the bundle is bent and using another of the two abutment pins on the same side of the bundle as a clamping and opposing pin to keep the bundle in position.

2. Bending assembly as in claim 1, in which the abutment plate has a first position for introduction of the bundle of bars, with the abutment pins positioned at the sides of the lengthwise axis of the bundle of bars, a second working position and a third working position, with the abutment pins rested against the bundle of bars on the opposite faces of that bundle.

3. Bending assembly as in claim 1, in which the rotary bending plate has a first position to make an upstream bend, in which the bending pin cooperates with the abutment pin farther from the feeding assembly, and a second position to make a downstream bend, in which the bending pin cooperates with the abutment pin nearer to the feeding assembly.

4. Bending assembly (10) as in claim 1, in which the abutment plate has a low position, in which it is positioned lower than the working surface.

5. Bending assembly as in claim 4, in which the abutment plate has a high position, in which it is positioned higher than the working surface.

6. Bending assembly as in claim 1, in which the rotary bending plate has a low position, in which it is positioned lower than the working surface.

7. Bending assembly as in claim 6, in which the rotary bending plate has a high position in which it is positioned higher than the working surface.

* * * * *